US007201146B2

(12) United States Patent
Araki

(10) Patent No.: US 7,201,146 B2
(45) Date of Patent: Apr. 10, 2007

(54) CONTROL APPARATUS FOR INTERNAL COMBUSTION ENGINE

(75) Inventor: Koji Araki, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/268,602

(22) Filed: Nov. 8, 2005

(65) Prior Publication Data

US 2006/0096577 A1 May 11, 2006

(30) Foreign Application Priority Data

Nov. 11, 2004 (JP) ..... 2004-328111

(51) Int. Cl.
*F02B 7/00* (2006.01)
*F02M 51/00* (2006.01)

(52) U.S. Cl. ..... 123/431; 123/478; 123/491

(58) Field of Classification Search ..... 123/431, 123/304, 305, 478, 295, 299, 406.47, 491; 701/103, 104, 105

See application file for complete search history.

(56) References Cited

U.S. PATENT DOCUMENTS 5,482,023 A 1/1996 Hunt et al.
5,894,832 A 4/1999 Nogi et al.
6,659,071 B2 * 12/2003 LaPointe et al. ..... 123/299
2004/0007209 A1 1/2004 Ohtani

FOREIGN PATENT DOCUMENTS

EP 1 138 901 A2 10/2001
EP 1 408 232 A2 4/2004
JP A-10-018884 1/1998
JP A-2004-060474 2/2004

* cited by examiner

*Primary Examiner*—Stephen K. Cronin
*Assistant Examiner*—Johnny H. Hoang
(74) *Attorney, Agent, or Firm*—Oliff & Berridge PLC

(57) ABSTRACT

An engine ECU executes a program including the steps of calculating an in-cylinder injector's injection ratio; if the ratio is 1, calculating a cold state increase value by employing a function f(1) having the engine's temperature as a parameter; if the ratio is 0, calculating a cold state increase value by employing a function f(2) having the engine's temperature as a parameter; and if the ratio is larger than 0 and smaller than 1, calculating a cold state increase value by employing a function f(3) having the engine's temperature and the ratio as parameters.

18 Claims, 7 Drawing Sheets

CONTROL APPARATUS FOR INTERNAL COMBUSTION ENGINE

This nonprovisional application is based on Japanese Patent Application No. 2004-328111 filed with the Japan Patent Office on Nov. 11, 2004, the entire contents of which are hereby incorporated by reference.

BACKGROUND OF THE INVENTION

1. Field of the Invention

The present invention relates to a control apparatus for an internal combustion engine having a first fuel injection mechanism (an in-cylinder injector) injecting fuel into a cylinder and a second fuel injection mechanism (an intake manifold injector) injecting the fuel into an intake manifold or an intake port, and particularly, to a technique wherein a fuel injection ratio between the first and second fuel injection mechanisms are considered to determine a fuel increase value in a cold state operation.

2. Description of the Background Art

An internal combustion engine having an intake manifold injector for injecting fuel into an intake manifold of the engine and an in-cylinder injector for injecting the fuel into a combustion chamber of the engine, and configured to stop fuel injection from the intake manifold injector when the engine load is lower than a preset load and to carry out fuel injection from the intake manifold injector when the engine load is higher than the set load, is known.

There is the following technique related to such an internal combustion engine. At a very low temperature, starting capability is impaired due to poor atomization of fuel. Additionally, at a very low temperature, the viscosity of a lubricating oil is high and therefore a friction increases and the number of cranking revolutions decreases. Accordingly, with a high-pressure fuel pump directly driven by an engine, a fuel pressure cannot fully be increased. A required fuel quantity may not be supplied to the engine solely with a fuel injection valve (a main fuel injection valve) provided for injecting a fuel directly into a combustion chamber, and the starting capability may further be impaired. Therefore, one proposal has been made to provide, in addition to the main fuel injection valve, a single auxiliary fuel injection valve, referred to as a cold start valve, at a collector portion upstream of an intake manifold for injecting the fuel only when the engine is started at a cold temperature (cold-start), in order to ensure a fuel quantity required at cold start that cannot be fully ensured solely with the main fuel injection valve.

A fuel supplying apparatus for an internal combustion engine of a direct-injection type disclosed in Japanese Patent Laying-Open No. 10-018884 is an apparatus for supplying fuel, which is delivered from a high-pressure pump of an engine-driven type, through direct injection into a cylinder via main fuel supplying means. The apparatus includes auxiliary fuel supplying means for supplementing a fuel supply from the main fuel supplying means at a prescribed start-up, and characterized in that a supply fuel quantity from the auxiliary fuel supplying means is estimated to correct a supply fuel quantity from the main fuel supplying means based on the estimation result.

According to the fuel supplying apparatus for an internal combustion engine of a direct-injection type, when it is necessary to actuate the auxiliary fuel supplying means (for example, when a fuel supplying pressure to the main fuel supplying means is lower than a prescribed value at cold-start), a supply fuel quantity from the auxiliary fuel supplying means is estimated, and a supply fuel quantity from the main fuel supplying means can be corrected based on the result. Accordingly, the actual supply fuel quantity to the engine can optimally be controlled to meet the supply fuel quantity required for the engine.

However, for a range shared by the in-cylinder injector and the intake manifold injector to both inject the fuel, including a transitional period from the cold state to a warm state, the cylinder's interior and the intake port increase in temperature at different rates, and therefore injected fuel deposits on the wall surface or on the top surface of the piston by different degrees. Accordingly, an accurate cold state increase value cannot be calculated if determined using only an engine coolant temperature.

SUMMARY OF THE INVENTION

An object of the present invention is to provide a control apparatus for an internal combustion engine having first and second fuel injection mechanisms bearing shares, respectively, of injecting fuel into a cylinder and an intake manifold, respectively, that can calculate an accurate fuel variation value in a cold state and a transitional period from the cold state to a warm state when the fuel injection mechanisms share injecting the fuel.

The present invention in one aspect provides a control apparatus for an internal combustion engine that controls an internal combustion engine having a first fuel injection mechanism injecting fuel into a cylinder and a second fuel injection mechanism injecting the fuel into an intake manifold. The control apparatus includes: a controller controlling the first and second fuel injection mechanisms to bear shares, respectively, of injecting the fuel at a ratio calculated as based on a condition required for the internal combustion engine; and a detector detecting a temperature of the internal combustion engine. The controller uses the ratio and the temperature to calculate a fuel variation value for the internal combustion engine in a cold state and applies the calculated fuel variation value to control the first and second fuel injection mechanisms to vary a fuel injection quantity.

In the present invention, for a range shared by the first fuel injection mechanism (e.g., an in-cylinder injector) and the second fuel injection mechanism (e.g., an intake manifold injector) to both inject the fuel the cylinder's interior and the intake port increase in temperature at different rates. In a cold state and a transitional period from the cold state to a warm state, because of this difference in temperature, an increase or a decrease in fuel is applied at different degrees. The controller considers a ratio between the fuel injected into the cylinder and that injected into the intake port and calculates as based on the internal combustion engine's temperature (e.g., that of a coolant of an engine) a fuel increase value or a fuel decrease value (collectively referred to as a fuel variation value) in the cold state. Thus the internal combustion engine having two fuel injection mechanisms that share injecting fuel into different portions can have an accurate fuel variation value in the cold state. Thus a control apparatus for an internal combustion engine can be provided that can calculate an accurate fuel variation value in a cold state and a transitional period from the cold state to a warm state when fuel injection mechanisms share injecting the fuel.

The present invention in another aspect provides a control apparatus for an internal combustion engine that controls an internal combustion engine having a first fuel injection mechanism injecting fuel into a cylinder and a second fuel injection mechanism injecting the fuel into an intake manifold. The control apparatus includes: a controller controlling the first and second fuel injection mechanisms to bear shares, respectively, of injecting the fuel at a ratio calculated as based on a condition required for the internal combustion engine; a detector detecting a temperature of the internal combustion engine; and a calculator calculating a reference injection quantity injected from said first and second fuel injection mechanisms. The controller uses said ratio and said temperature to calculate a fuel variation value for the internal combustion engine in a cold state and applies the calculated fuel variation value and the reference injection quantity to control the first and second fuel injection mechanisms to vary a fuel injection quantity.

In the present invention for a range shared by the first fuel injection mechanism (e.g., an in-cylinder injector) and the second fuel injection mechanism (e.g., an intake manifold injector) to both inject the fuel the cylinder's interior and the intake port increase in temperature at different rates. In a cold state and a transitional period from the cold state to a warm state, because of this difference in temperature, an increase or a decrease in fuel is applied at different degrees. The controller considers a ratio between the fuel injected into the cylinder and that injected into the intake port and calculates as based on the internal combustion engine's temperature (e.g., that of a coolant of an engine) a fuel variation value in the cold state. This fuel variation value and a reference injection quantity calculated as based on the internal combustion engine's operation state are used to vary a fuel injection quantity. Thus the internal combustion engine having two fuel injection mechanisms that share injecting fuel into different portions can achieve an accurately varied fuel injection quantity in the cold state. Thus a control apparatus for an internal combustion engine can be provided that can calculate an accurate fuel variation value in a cold state and a transitional period from the cold state to a warm state when fuel injection mechanisms share injecting the fuel, so that the fuel injection quantity is varied from the reference injection quantity.

The present invention in still another aspect provides a control apparatus for an internal combustion engine that controls an internal combustion engine having a first fuel injection mechanism injecting fuel into a cylinder and a second fuel injection mechanism injecting the fuel into an intake manifold. The control apparatus includes: a controller controlling the first and second fuel injection mechanisms to bear shares, respectively, of injecting the fuel at a ratio calculated as based on a condition required for the internal combustion engine; and a detector detecting a temperature of the internal combustion engine. The controller uses the ratio and the temperature to calculate a fuel increase value for the internal combustion engine in a cold state and applies the calculated fuel increase value to control the first and second fuel injection mechanisms to vary a fuel injection quantity.

In the present invention, for a range shared by the first fuel injection mechanism (e.g., an in-cylinder injector) and the second fuel injection mechanism (e.g., an intake manifold injector) to both inject the fuel the cylinder's interior and the intake port increase in temperature at different rates. In a cold state and a transitional period from the cold state to a warm state, because of this difference in temperature, an increase in fuel is applied at different degrees. The controller considers a ratio between the fuel injected into the cylinder and that injected into the intake port and calculates as based on the internal combustion engine's temperature (e.g., that of a coolant of an engine) a fuel increase value in the cold state. Thus the internal combustion engine having two fuel injection mechanisms that share injecting fuel into different portions can have an accurate fuel increase value in the cold state. Thus a control apparatus for an internal combustion engine can be provided that can calculate an accurate fuel increase value in a cold state and a transitional period from the cold state to a warm state when fuel injection mechanisms share injecting the fuel.

The present invention in still another aspect provides a control apparatus for an internal combustion engine that controls an internal combustion engine having a first fuel injection mechanism injecting fuel into a cylinder and a second fuel injection mechanism injecting the fuel into an intake manifold. The control apparatus includes: a controller controlling the first and second fuel injection mechanisms to bear shares, respectively, of injecting the fuel at a ratio calculated as based on a condition required for the internal combustion engine; a detector detecting a temperature of the internal combustion engine; and a calculator calculating a reference injection quantity injected from said first and second fuel injection mechanisms. The controller uses the ratio and the temperature to calculate a fuel increase value for the internal combustion engine in a cold state and applies the calculated fuel increase value and the reference injection quantity to control the first and second fuel injection mechanisms to vary a fuel injection quantity.

In the present invention, for a range shared by the first fuel injection mechanism (e.g., an in-cylinder injector) and the second fuel injection mechanism (e.g., an intake manifold injector) to both inject the fuel the cylinder's interior and the intake port increase in temperature at different rates. In a cold state and a transitional period from the cold state to a warm state, because of this difference in temperature, an increase in fuel is applied at different degrees. The controller considers a ratio between the fuel injected into the cylinder and that injected into the intake port and calculates as based on the internal combustion engine's temperature (e.g., that of a coolant of an engine) a fuel increase value in the cold state. This fuel increase value and a reference injection quantity calculated as based on the internal combustion engine's operation state are used to vary a fuel injection quantity. Thus the internal combustion engine having two fuel injection mechanisms that share injecting fuel into different portions can have an accurately varied fuel injection quantity in the cold state. Thus a control apparatus for an internal combustion engine can be provided that can calculate an accurate fuel increase value in a cold state and a transitional period from the cold state to a warm state when fuel injection mechanisms share injecting the fuel, so that the fuel injection quantity is varied from the reference injection quantity.

Preferably the controller calculates the fuel increase value to be decreased when the first fuel injection mechanism is increased in the ratio.

In accordance with the present invention, as the first fuel injection mechanism an in-cylinder injector injecting fuel into a cylinder exists, and the cylinder's internal temperature is higher than the intake port's temperature. As such, if the in-cylinder injector injects the fuel at higher ratios, it is not necessary to introduce a significant fuel increase value. Despite a small fuel increase value, combustion as desired can be achieved.

Still preferably the controller calculates the fuel increase value to be increased when the second fuel injection mechanism is increased in the ratio.

In accordance with the present invention, as the second fuel injection mechanism an intake manifold injector injecting fuel into an intake manifold exists, and the intake port's temperature is lower than the cylinder's internal temperature. As such, if the intake manifold injector injects the fuel at higher ratios, a significant fuel increase value can be introduced to achieve combustion as desired.

Still preferably the controller calculates the fuel increase value to be decreased when the temperature is increased.

In accordance with the present invention higher temperatures in the internal combustion engine help the fuel to atomize. As such, a large fuel increase value is not required and despite a small fuel increase value combustion as desired can be achieved.

Still preferably the controller calculates the fuel increase value to be increased when the temperature is decreased.

In accordance with the present invention lower temperatures in the internal combustion engine prevent the fuel from atomizing. Accordingly, a large fuel increase value is introduced so that combustion as desired can be achieved.

Still preferably the first fuel injection mechanism is an in-cylinder injector and the second fuel injection mechanism is an intake manifold injector.

In accordance with the present invention a control apparatus can be provided that can calculate an accurate fuel increase value for an internal combustion engine having separately provided first and second fuel injection mechanisms implemented by an in-cylinder injector and an intake manifold injector to share injecting fuel when they share injecting the fuel in a cold state and a transitional period from the cold state to a warm state.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Hereinafter reference will be made to the drawings to describe the present invention in embodiments. In the following description identical components are identically denoted. They are also identical in name and function. Therefore, detailed description thereof will not be repeated. Note that while the following description is provided exclusively in conjunction with a fuel increase in a cold state, the present invention is not limited to such an increase. The present invention also includes once increasing fuel and then decreasing the fuel and decreasing from a reference injection quantity.

First Embodiment

Figure 1:
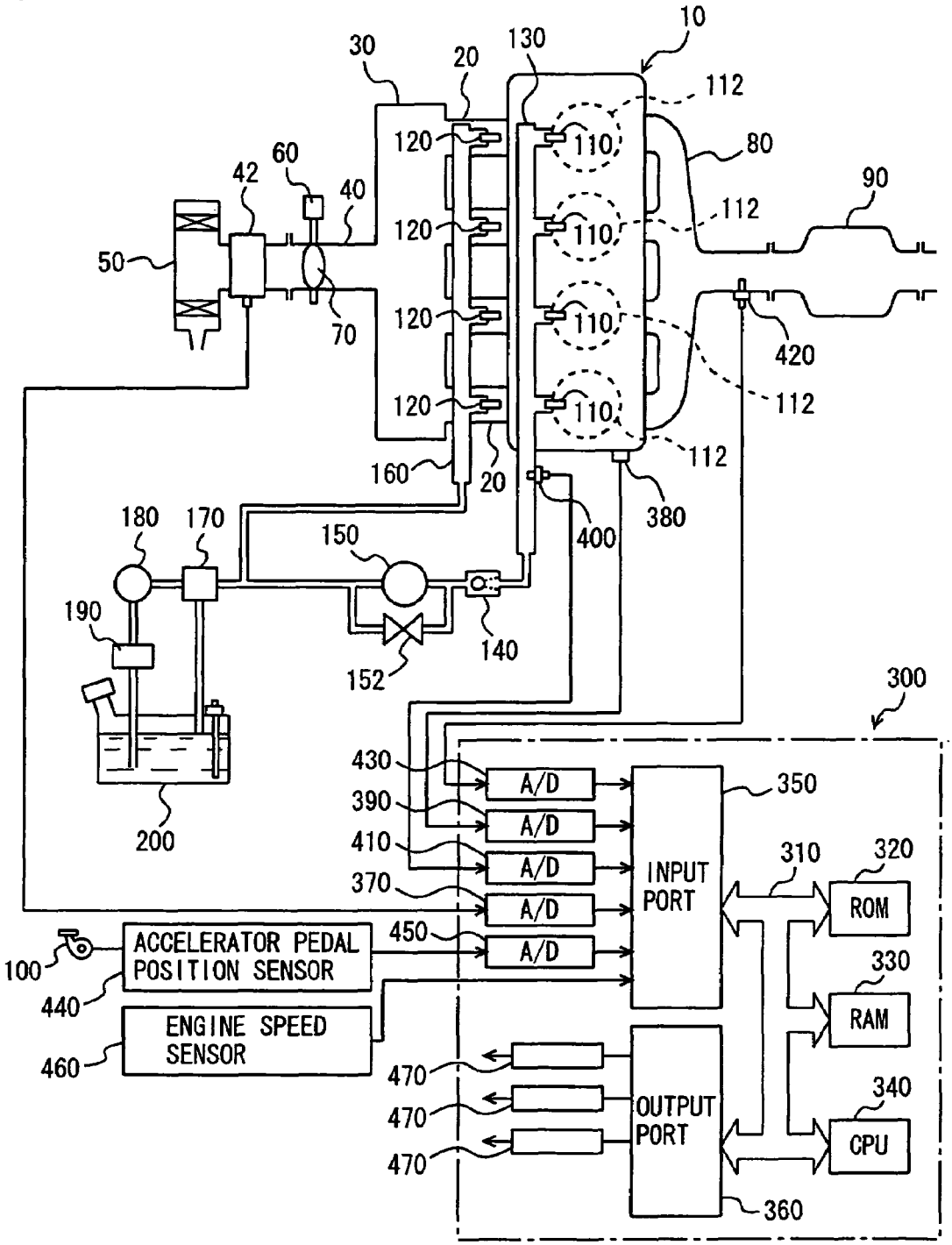
FIG. 1 a schematic configuration diagram of an engine system controlled by a control apparatus according to a first embodiment of the present invention.

FIG. 1 is a schematic configuration diagram of an engine system that is controlled by an engine ECU (Electronic Control Unit) implementing the control apparatus for an internal combustion engine according to an embodiment of the present invention. In FIG. 1, an in-line 4-cylinder gasoline engine is shown, although the application of the present invention is not restricted to such an engine.

As shown in FIG. 1, engine 10 includes four cylinders 112, each connected via a corresponding intake manifold 20 to a common surge tank 30. Surge tank 30 is connected via an intake duct 40 to an air cleaner 50. An airflow meter 42 is arranged in intake duct 40, and a throttle valve 70 driven by an electric motor 60 is also arranged in intake duct 40. Throttle valve 70 has its degree of opening controlled based on an output signal of an engine ECU 300, independently from an accelerator pedal 100. Each cylinder 112 is connected to a common exhaust manifold 80, which is connected to a three-way catalytic converter 90.

Each cylinder 112 is provided with an in-cylinder injector 110 for injecting fuel into the cylinder and an intake manifold injector 120 for injecting fuel into an intake port or/and an intake manifold. Injectors 110 and 120 are controlled based on output signals from engine ECU 300. Further, in-cylinder injector 110 of each cylinder is connected to a common fuel delivery pipe 130. Fuel delivery pipe 130 is connected to a high-pressure fuel pump 150 of an engine-driven type, via a check valve 140 that allows a flow in the direction toward fuel delivery pipe 130. In the present embodiment, an internal combustion engine having two injectors separately provided is explained, although the present invention is not restricted to such an internal combustion engine. For example, the internal combustion engine may have one injector that can effect both in-cylinder injection and intake manifold injection.

As shown in FIG. 1, the discharge side of high-pressure fuel pump 150 is connected via an electromagnetic spill valve 152 to the intake side of high-pressure fuel pump 150. As the degree of opening of electromagnetic spill valve 152 is smaller, the quantity of the fuel supplied from high-pressure fuel pump 150 into fuel delivery pipe 130 increases. When electromagnetic spill valve 152 is fully open, the fuel supply from high-pressure fuel pump 150 to fuel delivery pipe 130 is stopped. Electromagnetic spill valve 152 is controlled based on an output signal of engine ECU 300.

Each intake manifold injector 120 is connected to a common fuel delivery pipe 160 on a low pressure side. Fuel delivery pipe 160 and high-pressure fuel pump 150 are connected via a common fuel pressure regulator 170 to a low-pressure fuel pump 180 of an electric motor-driven type. Further, low-pressure fuel pump 180 is connected via a fuel filter 190 to a fuel tank 200. Fuel pressure regulator 170 is configured to return a part of the fuel discharged from low-pressure fuel pump 180 back to fuel tank 200 when the pressure of the fuel discharged from low-pressure fuel pump 180 is higher than a preset fuel pressure. This prevents both the pressure of the fuel supplied to intake manifold injector 120 and the pressure of the fuel supplied to high-pressure fuel pump 150 from becoming higher than the above-described preset fuel pressure.

Engine ECU 300 is implemented with a digital computer, and includes a ROM (Read Only Memory) 320, a RAM (Random Access Memory) 330, a CPU (Central Processing Unit) 340, an input port 350, and an output port 360, which are connected to each other via a bidirectional bus 310.

Airflow meter 42 generates an output voltage that is proportional to an intake air quantity, and the output voltage is input via an A/D converter 370 to input port 350. A coolant temperature sensor 380 is attached to engine 10, and generates an output voltage proportional to a coolant temperature of the engine, which is input via an A/D converter 390 to input port 350.

A fuel pressure sensor 400 is attached to fuel delivery pipe 130, and generates an output voltage proportional to a fuel pressure within fuel delivery pipe 130, which is input via an A/D converter 410 to input port 350. An air-fuel ratio sensor 420 is attached to an exhaust manifold 80 located upstream of three-way catalytic converter 90. Air-fuel ratio sensor 420 generates an output voltage proportional to an oxygen concentration within the exhaust gas, which is input via an A/D converter 430 to input port 350.

Air-fuel ratio sensor 420 of the engine system of the present embodiment is a full-range air-fuel ratio sensor (linear air-fuel ratio sensor) that generates an output voltage proportional to the air-fuel ratio of the air-fuel mixture burned in engine 10. As air-fuel ratio sensor 420, an $O_2$ sensor may be employed, which detects, in an on/off manner, whether the air-fuel ratio of the air-fuel mixture burned in engine 10, is rich or lean with respect to a theoretical air-fuel ratio.

Accelerator pedal 100 is connected with an accelerator pedal position sensor 440 that generates an output voltage proportional to the degree of press down of accelerator pedal 100, which is input via an A/D converter 450 to input port 350. Further, an engine speed sensor 460 generating an output pulse representing the engine speed is connected to input port 350. ROM 320 of engine ECU 300 prestores, in the form of a map, values of fuel injection quantity that are set in association with operation states based on the engine load factor and the engine speed obtained by the above-described accelerator pedal position sensor 440 and engine speed sensor 460, and correction values thereof set based on the engine coolant temperature.

Figure 2:
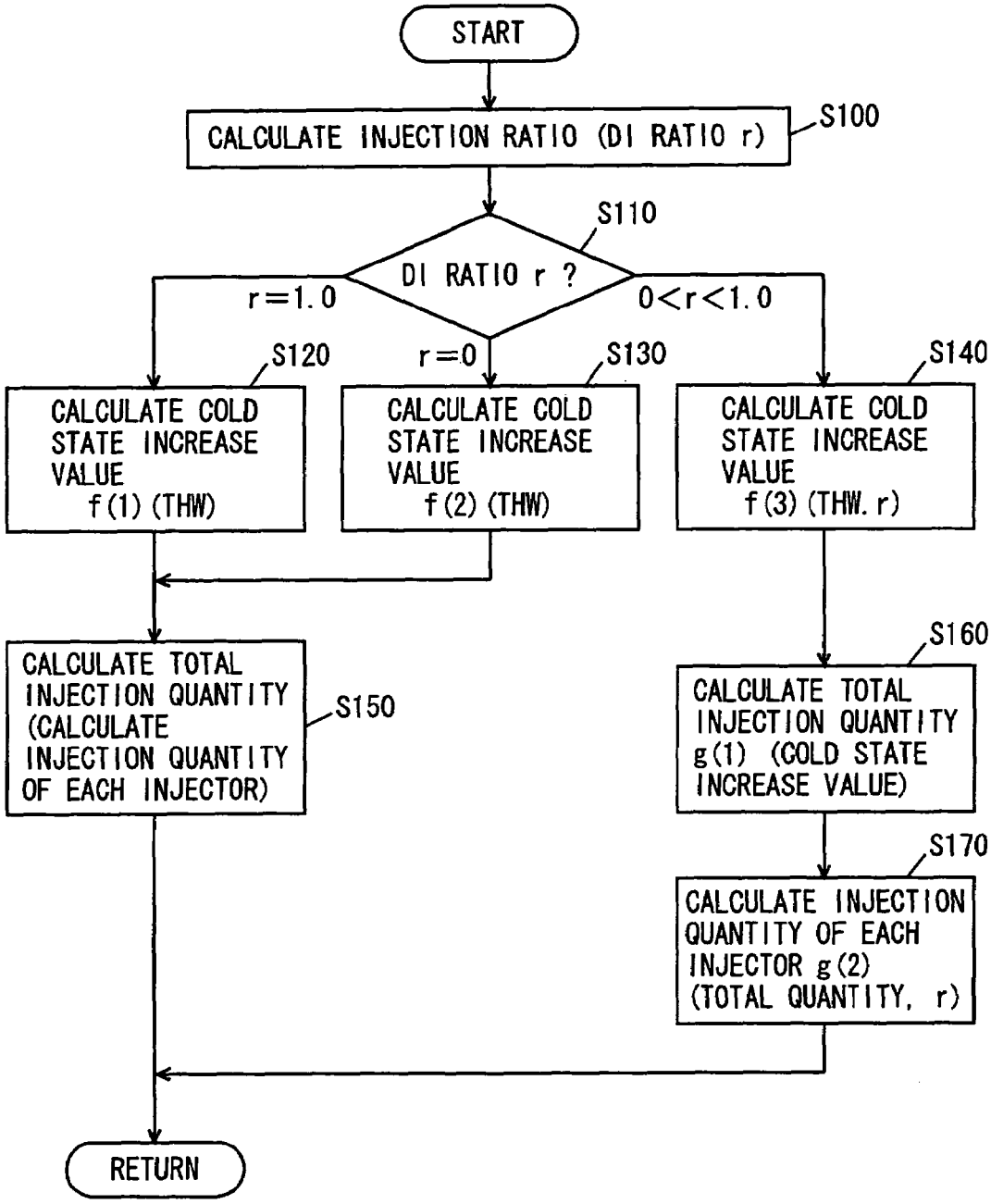
FIG. 2 is a flowchart indicative of a control structure of a program executed by an engine ECU implementing the control apparatus according to the first embodiment of the present invention.

With reference to the flowchart of FIG. 2, engine ECU 300 of FIG. 1 executes a program having a structure for control, as described hereinafter.

In step (hereinafter step is abbreviated as S) 100 engine ECU 300 employs a map which will be described later (FIGS. 7–10) to calculate an injection ratio of in-cylinder injector 110 (hereinafter this ratio will be referred to as "DI ratio r ($0 \leqq r \leqq 1$)."

In S100 engine ECU 300 determines whether DI ratio r is 1, 0, or larger than 0 and smaller than 1. If DI ratio r is 1 (r=1.0 in S110) the process proceeds to S120. If DI ratio r is 0 (r=0 in S110) the process proceeds to S130. If DI ratio r is larger than 0 and smaller than 1 ($0<r<1$ in S110) the process proceeds to S140.

In S120 engine ECU 300 calculates a fuel increase value in a cold state when in-cylinder injector 110 alone injects fuel. This is done for example by employing a function f(1) to calculate a cold state increase value=f(1) (THW). Note that "THW" represents the temperature of a coolant of engine 10 as detected by coolant temperature sensor 380.

In S130 engine ECU 300 calculates a fuel increase value in a cold state when intake manifold injector 120 alone injects fuel. This is done for example by employing a function f(2) to calculate a cold state increase value=f(2) (THW).

Figure 3:
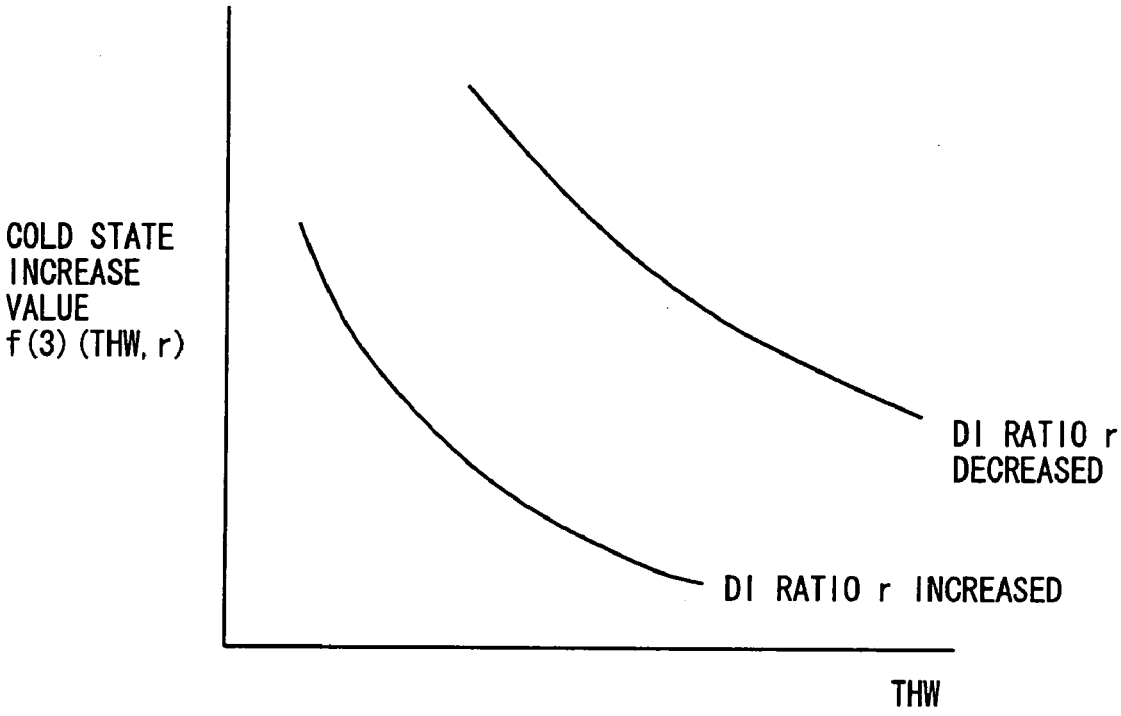
FIG. 3 shows the relationship between an engine coolant temperature and a cold state increase value in shared injection.

In S140 engine ECU 300 calculates a fuel increase value in a cold state when in-cylinder and intake manifold injectors 110 and 120 bear shares, respectively, of injecting fuel. This is done for example by employing a function f(3) to calculate a cold state increase value=f(3) (THW, r). Note that "r" represents a DI ratio. As shown in FIG. 3, a cold state increase value is calculated based on engine coolant temperature THW, employing DI ratio r as a parameter. As shown in FIG. 3, as engine coolant temperature THW is lower, a greater quantity of fuel injected into the cylinder deposits on the top surface of piston and a greater quantity of fuel injected into the intake port deposits on the wall. Therefore, a cold state correction quantity f(3) (THW, r) is set to be greater. At the same engine coolant temperature THW, as the temperature of the intake port is lower than that in the cylinder, the fuel deposits in a greater quantity on the intake port. Therefore, cold state increase value f(3) (THW, r) is set to be greater as DI ratio r is lower. It is noted that the relationship shown in FIG. 3 may be inverted. For example if the performance of an in-cylinder injector 100 as a discrete injector and that of an intake manifold injector 120 as a discrete injector contribute to less sufficient atomization of the fuel injected through in-cylinder injector 100 than that of the fuel injected through intake manifold injector 120 for the same engine coolant temperature THW, the DI ratio-cold state increase value relationship shown in FIG. 3 can be inverted. This holds true for FIGS. 5 and 6, which will be described later.

In S150, engine ECU 300 calculates a total injection quantity. Specifically, it adds a cold state increase value to a reference injection quantity (in-cylinder injector 110 solely or intake manifold injector 120 solely) calculated based on an operation state of engine 10, to calculate the total injection quantity of fuel injected from each injector. Here, as fuel injection is carried out solely by in-cylinder injector 110 (DI ratio r=1.0) or solely by the intake manifold injector (DI ratio r=0), by simply adding the cold state increase value to the reference injection quantity as to each injector, the total injection quantity of each injector can be calculated.

In S160, engine ECU 300 calculates a total injection quantity. Here, the total injection quantity is calculated as follows, using, for example, a function g(1): total injection quantity=g(1) (cold state increase value). For example, by adding a cold state increase value (in-cylinder injector 110+intake manifold injector 120) to a reference injection quantity (in-cylinder injector 110+intake manifold injector 120) calculated based on an operation state of engine 10, a total injection quantity injected from in-cylinder injector 110 and intake manifold injector 120 is calculated.

In S170, engine ECU 300 calculates an injection quantity of each injector. Here, an injection quantity of each injector is calculated as follows, using, for example, a function g(2): injection quantity of in-cylinder injector 110=g(2) (total injection quantity, r)=total injection quantity×r; injection quantity of intake manifold injector 120=total injection quantity−g(2) (total injection quantity, r)=total injection quantity×(1−r).

As based on the configuration and flowchart as described above, engine 10 in the present embodiment operates as described hereinafter. Note that in the following description "if the engine's coolant varies in temperature" and other similar expressions indicate a transitional period from a cold state to a warm state.

In a cold state, which is until engine 10 is fully warmed after it is started, an injection ratio (DI ratio r) is calculated based on an operation state of engine 10 (S100). When DI ratio r is larger than 0 and smaller than 1 (in other words, when in-cylinder and intake manifold injectors 110 and 120 bear shares, respectively, of injecting fuel) (0<r<1.0 in S110), a cold state increase value is calculated using a map (function f(3) (THW, r)) shown in FIG. 3 (S140). Here, DI ratio r is considered.

Using the calculated cold state increase value, a total injection quantity is calculated (S160). The total injection quantity as used herein is a fuel quantity injected from both in-cylinder injector 110 and intake manifold injector 120. Using the calculated total injection quantity, an injection quantity of each injector is calculated (S170). Here, a fuel injection quantity of in-cylinder injector 110 and a fuel injection quantity of intake manifold injector 120 are calculated. Using the calculation result (injection quantity of each injector), engine ECU 300 causes in-cylinder injector 110 and intake manifold injector 120 to inject prescribed fuel.

Thus in a cold state and a transitional period from the cold state to a warm state when an in-cylinder injector and an intake manifold injector bear shares, respectively, of injecting fuel, not only temperature THW of the coolant of the engine but DI ratio r is also used to calculate a cold state increase value. If the cylinder's interior and the port are different in temperature and thus have fuel therein atomized differently, fuel can be injected by a quantity to which an accurate cold state increase value is added, to combust the fuel satisfactorily.

Second Embodiment

In the following, an engine system controlled by an engine ECU implementing a control apparatus for an internal combustion engine of the present embodiment will now be described. In the present embodiment, description of a structure that is the same as in the above-described first embodiment will not be repeated. For example, a schematic structure of the engine system in the present embodiment is the same as that of the engine system shown in FIG. 1. In the present embodiment, a program that is different from the program executed by engine ECU 300 in the above-described first embodiment will be executed.

Figure 4:
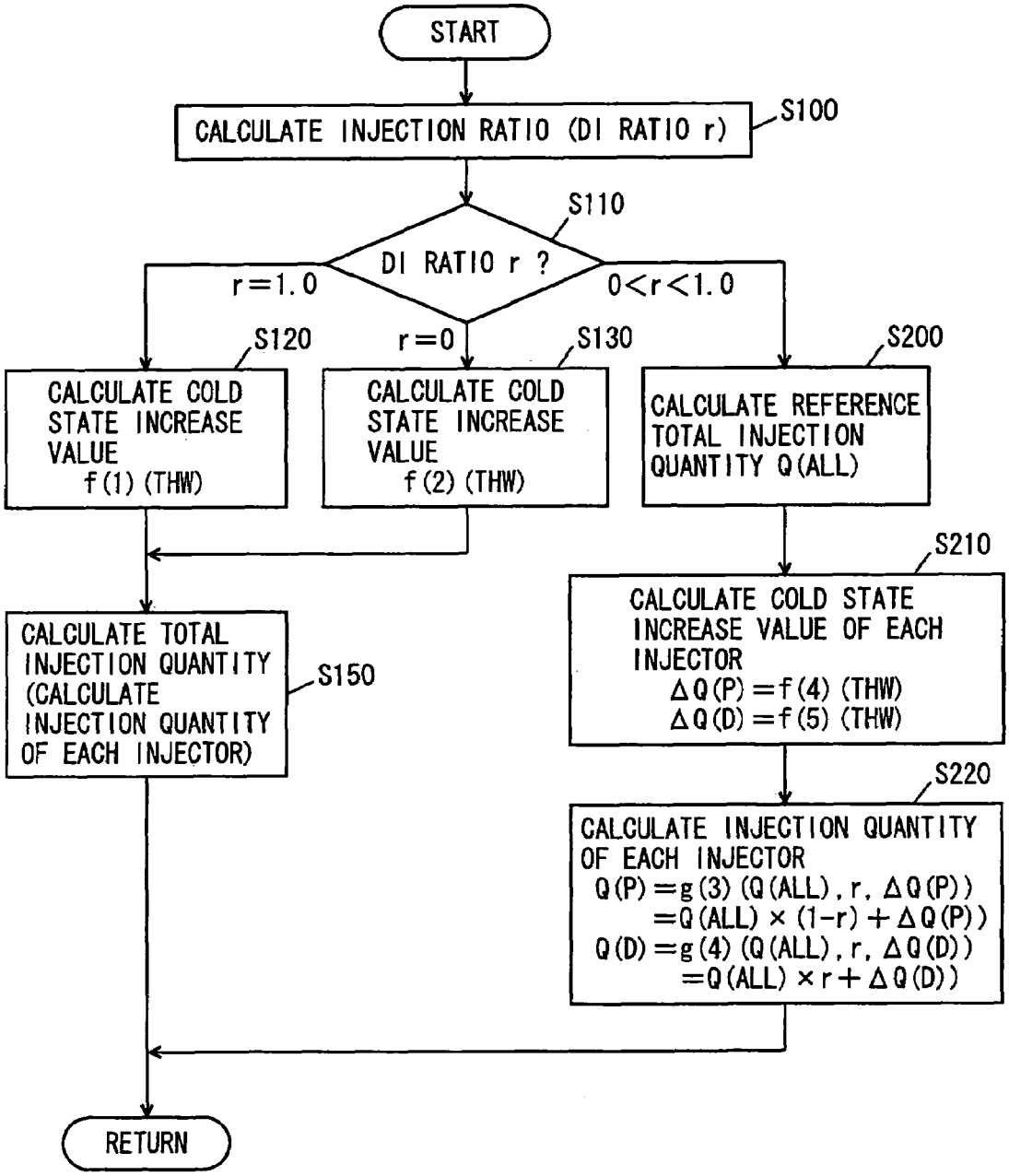
FIG. 4 is a flowchart indicative of a control structure of a program executed by an engine ECU implementing a control apparatus according to a second embodiment of the present invention.

Referring to the flowchart of FIG. 4, a control structure of the program executed at engine ECU 300 is now described. In the flowchart of FIG. 4, process steps that are the same as in the flowchart of FIG. 2 have the same step number allotted. The processes are also the same. Thus, detailed description thereof will not be repeated here.

In S200, engine ECU 300 calculates a reference total injection quantity Q(ALL). Here, engine ECU calculates reference total injection quantity Q(ALL) based on a required torque based on a degree of opening, required torque from other ECU and the like.

In S210, engine ECU 300 calculates a cold state increase value of each injector. Here, it is calculated as follows, using functions f(4) and f(5):

cold state increase value $\Delta Q(P)$ of intake manifold injector 120=$f(4)$(THW)

cold state increase value $\Delta Q(D)$ of in-cylinder injector 110=$f(5)$(THW)

Figure 5:
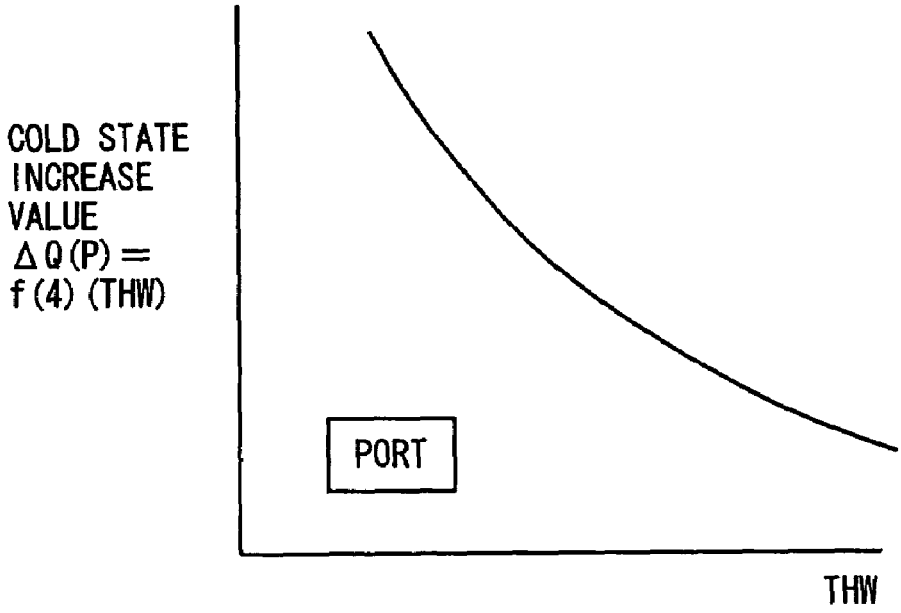
FIG. 5 shows the relationship between an engine coolant temperature and a cold state increase value when fuel injection is carried out only by an intake manifold injector.
Figure 6:
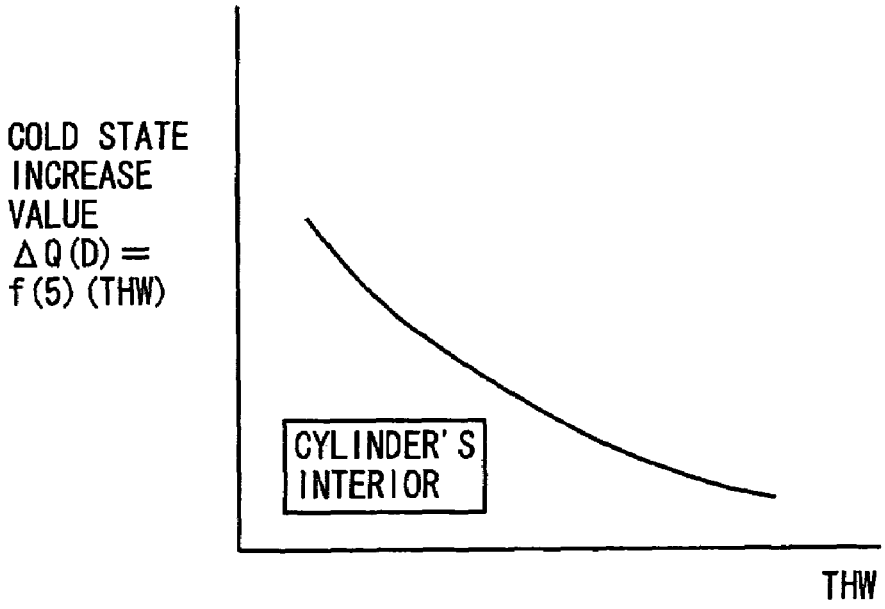
FIG. 6 shows the relationship between an engine coolant temperature and a cold state increase value when fuel injection is carried out only by an in-cylinder injector.

Here, as shown in FIGS. 5 and 6, the cold state increase value is calculated based on engine coolant temperature THW. FIG. 5 shows cold state increase value ΔQ (P) of intake manifold injector 120, while FIG. 6 shows cold state increase value ΔQ (D) of in-cylinder injector 110. As shown in FIGS. 5 and 6, as engine coolant temperature THW is lower, a greater quantity of fuel injected into the cylinder deposits on the top surface of piston and a greater quantity of fuel injected into the intake port deposits on the wall. therefore cold state correction quantity f(4) (THW) as well as cold state correction quantity f(5) (THW) are set to be greater. It is noted that, at the same engine coolant temperature THW, cold state correction quantity f(4) (THW)>cold state correction quantity f(5) (THW). This indicates that cold state increase value ΔQ (P) of intake manifold injector 120 shown in FIG. 5 is set to be greater than cold state increase value ΔQ (D) of in-cylinder injector 110 shown in FIG. 6, since greater quantity of fuel deposits on the intake port due to the temperature of the intake port being lower than the temperature in the cylinder.

In S220, engine ECU 300 calculates an injection quantity of each injector. Here, it is calculated as follows, using functions g(3) and g(4):

injection quantity $Q(P)$ of intake manifold injector 120=$g(3)(Q(\mathrm{ALL}),r;\Delta Q(P)=Q(\mathrm{ALL})\times(1-r)+\Delta Q(P)$ injection quantity $Q(D)$ of in-cylinder injector 110=$g(4)(Q(\mathrm{ALL}),r;\Delta Q(D)=Q(\mathrm{ALL})\times r+\Delta Q(D)$ It is noted that these equations may be expressed as follows, employing ΔQ (P) and ΔQ (D) as cold state increase coefficients:

injection quantity $Q(P)$ of intake manifold injector 120=$g(3)(Q(\mathrm{ALL}),r;\Delta Q(P)=Q(\mathrm{ALL})\times(1-r)\times\Delta Q(P)$ injection quantity $Q(D)$ of in-cylinder injector 110=$g(4)(Q(\mathrm{ALL}),r;\Delta Q(D)=Q(\mathrm{ALL})\times r\times\Delta Q(D)$ An operation of engine 10 of the present embodiment based on the above-described structure and flowchart will now be described. Description of operations that are the same as in the first embodiment will not be repeated.

In a cold state, which is until engine 10 is fully warmed after it is started, an injection ratio (DI ratio r) is calculated based on an operation state of engine 10 (S100). When DI ratio r is larger than 0 and smaller than 1 (in other words, when in-cylinder and intake manifold injectors 110 and 120 bear shares, respectively, of injecting fuel) (0<r<1.0 in S110), a reference total injection quantity Q (ALL) that is a reference fuel injection quantity injected from both injectors is calculated (S200).

Cold state increase value ΔQ (P) of intake manifold injector 120 and cold state increase value ΔQ (D) of in-cylinder injector 110 are calculated using maps (functions f(4) (THW), f(5) THW)) shown in FIGS. 5 and 6 (S210). An injection quantity of each intake manifold injector 120 and in-cylinder injector 110 is calculated (S220). Here, DI ratio 4 is considered.

Thus, in the present embodiment also, in a cold state and a transitional period from the cold state to a warm state when an in-cylinder injector and an intake manifold injector bear shares, respectively, of injecting fuel, temperature THW of the coolant of the engine is solely used to calculate a cold state increase value for each injector, and then DI ratio r is considered to calculate an injection quantity of each injector. Thus, if the cylinder's interior and the port are different in temperature and thus have fuel therein atomized differently, fuel can be injected by a quantity to which an accurate cold state increase value is added, to combust the fuel satisfactorily.

Engine (1) to Which Present Control Apparatus is Suitably Applied

An engine (1) to which the control apparatus of the present embodiment is suitably applied will now be described.

Figure 7:
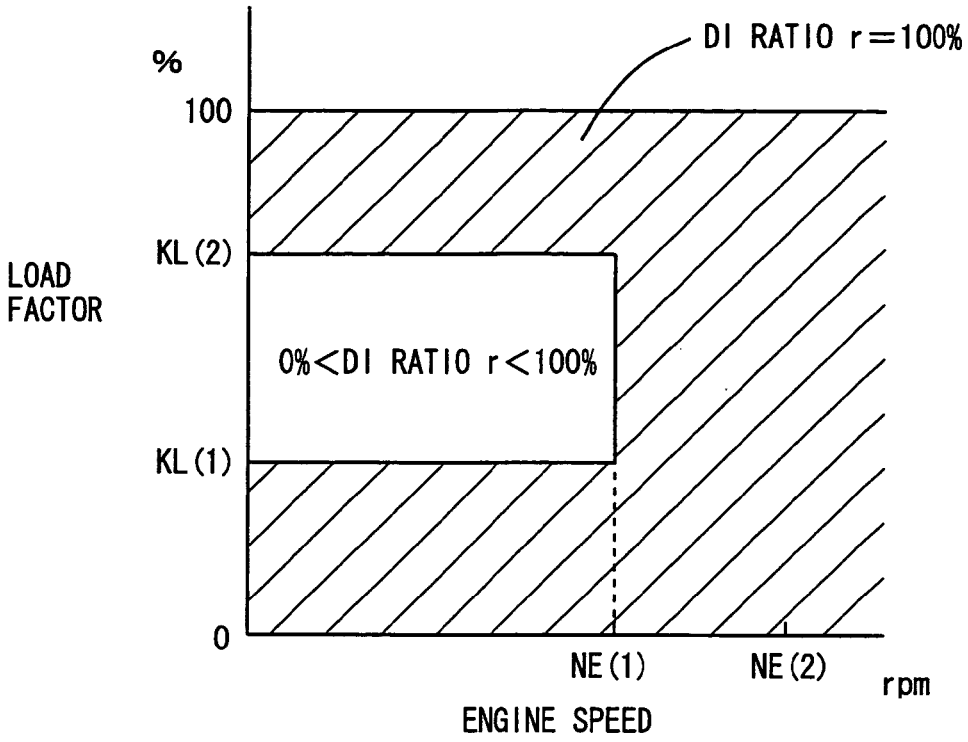
FIGS. 7 and 9 show a DI ratio map for a warm state of an engine to which the present control apparatus is suitably applied.
Figure 8:
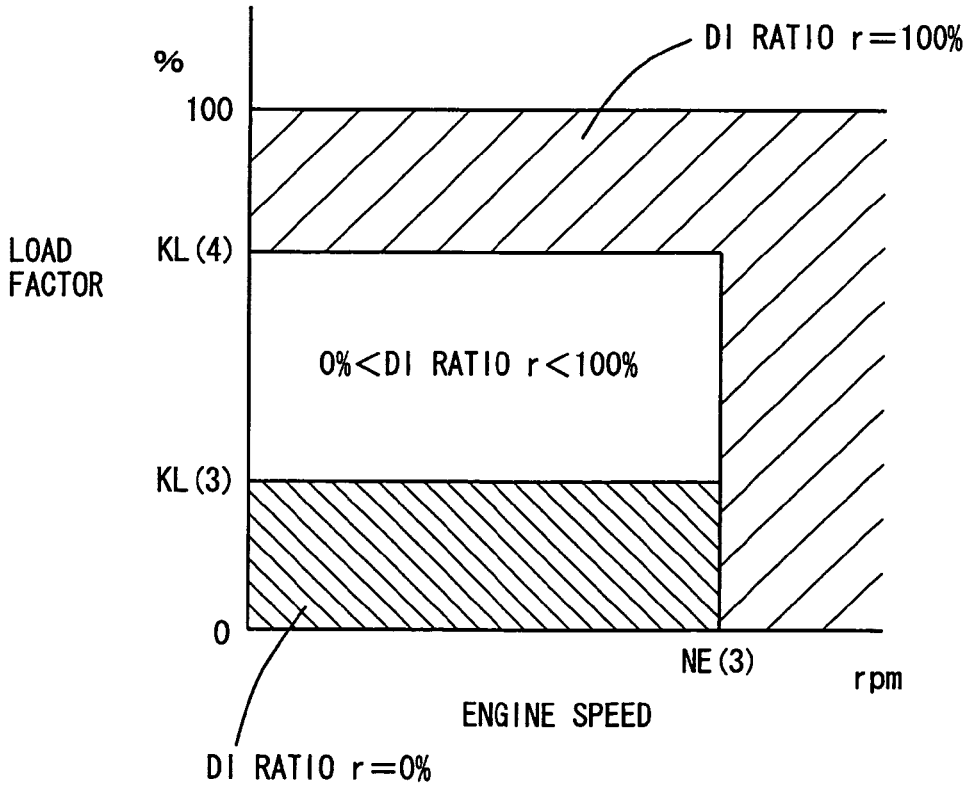
FIGS. 8 and 10 show a DI ratio map for a cold state of an engine to which the present control apparatus is suitably applied.

Referring to FIGS. 7 and 8, maps each indicating a fuel injection ratio between in-cylinder injector 110 and intake manifold injector 120, identified as information associated with an operation state of engine 10, will now be described. Herein, the fuel injection ratio between the two injectors is also expressed as a ratio of the quantity of the fuel injected from in-cylinder injector 110 to the total quantity of the fuel injected, which is referred to as the "fuel injection ratio of in-cylinder injector 110", or a "DI (Direct Injection) ratio (r)". The maps are stored in ROM 320 of engine ECU 300. FIG. 7 is the map for a warm state of engine 10, and FIG. 8 is the map for a cold state of engine 10.

In the maps illustrated in FIGS. 7 and 8, with the horizontal axis representing an engine speed of engine 10 and the vertical axis representing a load factor, the fuel injection ratio of in-cylinder injector 110, or the DI ratio r, is expressed in percentage.

As shown in FIGS. 7 and 8, the DI ratio r is set for each operation range that is determined by the engine speed and the load factor of engine 10. "DI RATIO r=100%" represents the range where fuel injection is carried out using only in-cylinder injector 110, and "DI RATIO r=0%" represents the range where fuel injection is carried out using only intake manifold injector 120. "DI RATIO r≠0%", "DI RATIO r≠100%" and "0%<DI RATIO r<100%" each represent the range where fuel injection is carried out using both in-cylinder injector 110 and intake manifold injector 120. Generally, in-cylinder injector 110 contributes to an increase of output performance, while intake manifold injector 120 contributes to uniformity of the air-fuel mixture. These two kinds of injectors having different characteristics are appropriately selected depending on the engine speed and the load factor of engine 10, so that only homogeneous combustion is conducted in the normal operation state of the engine (other than the abnormal operation state such as a catalyst warm-up state during idling).

Further, as shown in FIGS. 7 and 8, the fuel injection ratio between in-cylinder injector 110 and intake manifold injector 120, or, the DI ratio r, is defined individually in the map for the warm state and in the map for the cold state of the engine. The maps are configured to indicate different control ranges of in-cylinder injector 110 and intake manifold injector 120 as the temperature of engine 10 changes. When the temperature of engine 10 detected is equal to or higher than a predetermined temperature threshold value, the map for the warm state shown in FIG. 7 is selected; otherwise, the map for the cold state shown in FIG. 8 is selected. One or both of in-cylinder injector 110 and intake manifold injector 120 are controlled based on the selected map and according to the engine speed and the load factor of engine 10.

The engine speed and the load factor of engine 10 set in FIGS. 7 and 8 will now be described. In FIG. 7, NE(1) is set to 2500 rpm to 2700 rpm, KL(1) is set to 30% to 50%, and KL(2) is set to 60% to 90%. In FIG. 8, NE(3) is set to 2900 rpm to 3100 rpm. That is, NE(1)<NE(3). NE(2) in FIG. 7 as well as KL(3) and KL(4) in FIG. 8 are also set as appropriate.

When comparing FIG. 7 and FIG. 8, NE(3) of the map for the cold state shown in FIG. 8 is greater than NE(1) of the map for the warm state shown in FIG. 7. This shows that, as the temperature of engine 10 is lower, the control range of intake manifold injector 120 is expanded to include the range of higher engine speed. That is, in the case where engine 10 is cold, deposits are unlikely to accumulate in the injection hole of in-cylinder injector 110 (even if the fuel is not injected from in-cylinder injector 110). Thus, the range where the fuel injection is to be carried out using intake manifold injector 120 can be expanded, to thereby improve homogeneity.

When comparing FIG. 7 and FIG. 8, "DI RATIO r=100%" in the range where the engine speed of engine 10 is NE(1) or higher in the map for the warm state, and in the range where the engine speed is NE(3) or higher in the map for the cold state. In terms of load factor, "DI RATIO r=100%" in the range where the load factor is KL(2) or greater in the map for the warm state, and in the range where the load factor is KL(4) or greater in the map for the cold state. This means that in-cylinder injector 110 solely is used in the range of a predetermined high engine speed, and in the range of a predetermined high engine load. That is, in the high speed range or the high load range, even if fuel injection is carried out using only in-cylinder injector 110, the engine speed and the load of engine 10 are high, ensuring a sufficient intake air quantity, so that it is readily possible to obtain a homogeneous air-fuel mixture even using only in-cylinder injector 110. In this manner, the fuel injected from in-cylinder injector 110 is atomized within the combustion chamber involving latent heat of vaporization (or, absorbing heat from the combustion chamber). Thus, the temperature of the air-fuel mixture is decreased at the compression end, whereby antiknock performance is improved. Further, since the temperature within the combustion chamber is decreased, intake efficiency improves, leading to high power output.

In the map for the warm state in FIG. 7, fuel injection is also carried out using only in-cylinder injector 110 when the load factor is KL(1) or less. This shows that in-cylinder injector 110 alone is used in a predetermined low load range when the temperature of engine 10 is high. When engine 10 is in the warm state, deposits are likely to accumulate in the injection hole of in-cylinder injector 110. However, when fuel injection is carried out using in-cylinder injector 110, the temperature of the injection hole can be lowered, whereby accumulation of deposits is prevented. Further, clogging of in-cylinder injector 110 may be prevented while ensuring the minimum fuel injection quantity thereof. Thus, in-cylinder injector 110 alone is used in the relevant range.

When comparing FIG. 7 and FIG. 8, there is a range of "DI RATIO r=0%" only in the map for the cold state in FIG. 8. This shows that fuel injection is carried out using only intake manifold injector 120 in a predetermined low load range (KL(3) or less) when the temperature of engine 10 is low. When engine 10 is cold and low in load and the intake air quantity is small, atomization of the fuel is unlikely to occur. In such a range, it is difficult to ensure favorable combustion with the fuel injection from in-cylinder injector 110. Further, particularly in the low-load and low-speed range, high output using in-cylinder injector 110 is unnecessary. Accordingly, fuel injection is carried out using only intake manifold injector 120, rather than in-cylinder injector 110, in the relevant range.

Further, in an operation other than the normal operation, or, in the catalyst warm-up state during idling of engine 10 (abnormal operation state), in-cylinder injector 110 is controlled to carry out stratified charge combustion. By causing the stratified charge combustion during the catalyst warm-up operation, warming up of the catalyst is promoted, and exhaust emission is thus improved.

Engine (2) to which Present Control Apparatus is Suitably Applied Hereinafter, an engine (2) to which the control apparatus of the present embodiment is suitably applied will be described. In the following description of the engine (2), the configurations similar to those of the engine (1) will not be repeated.

Figure 9:
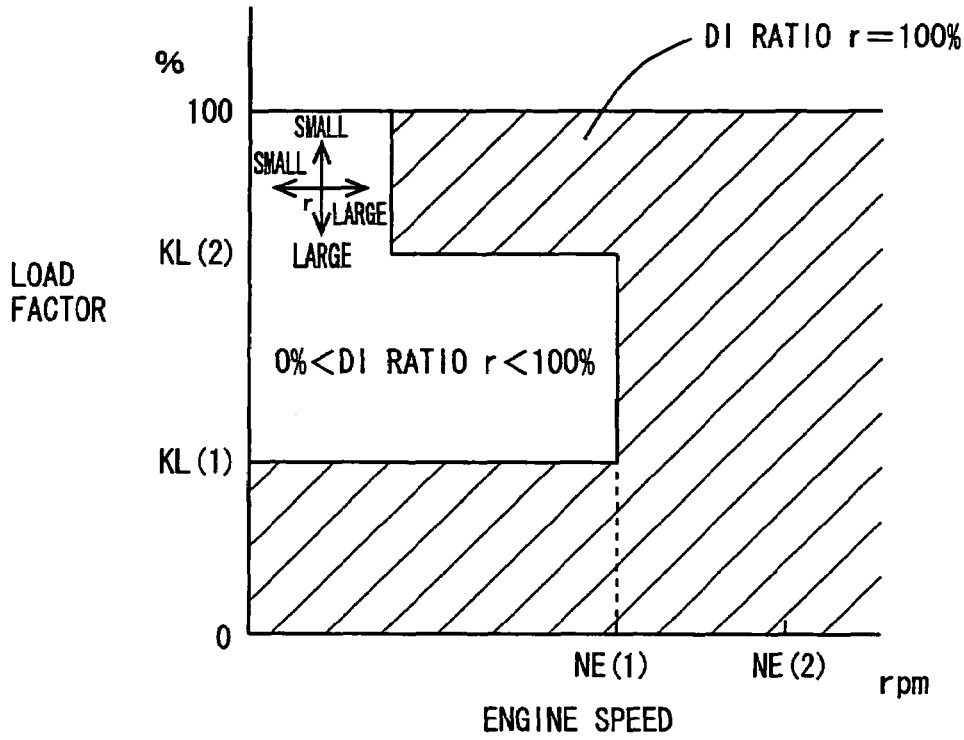
Figure 10:
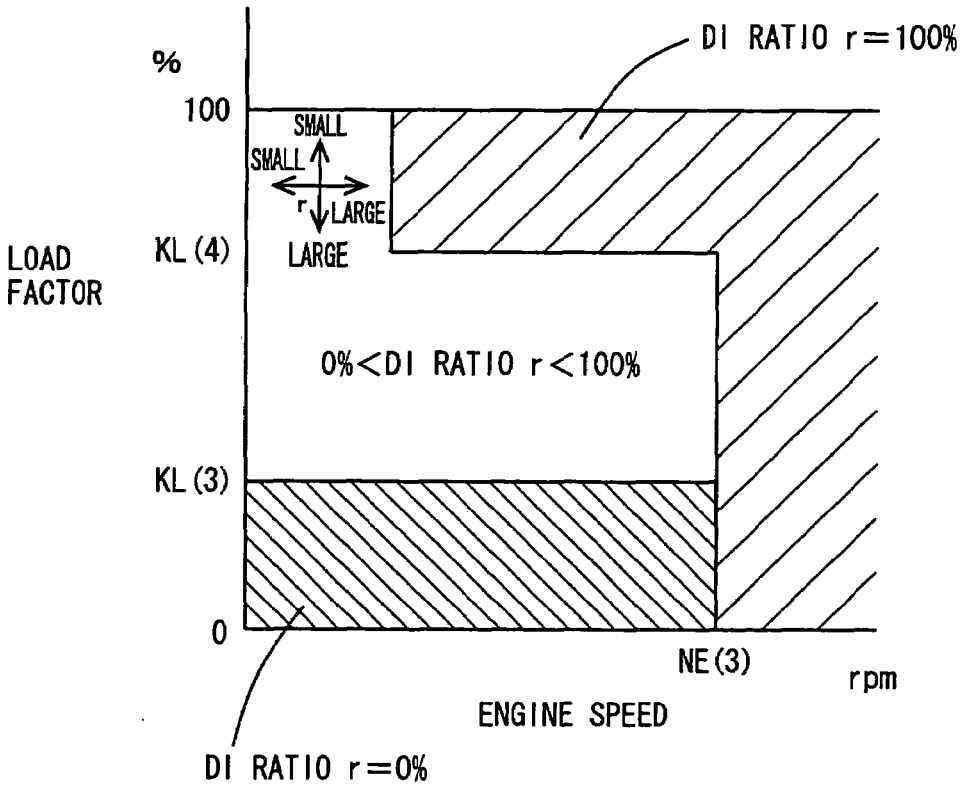

Referring to FIGS. 9 and 10, maps each indicating the fuel injection ratio between in-cylinder injector 110 and intake manifold injector 120, identified as information associated with the operation state of engine 10, will be described. The maps are stored in ROM 320 of engine ECU 300. FIG. 9 is the map for the warm state of engine 10, and FIG. 10 is the map for the cold state of engine 10.

FIGS. 9 and 10 differ from FIGS. 7 and 8 in the following points. "DI RATIO r=100%" holds in the range where the engine speed of the engine is equal to or higher than NE(1) in the map for the warm state, and in the range where the engine speed is NE(3) or higher in the map for the cold state. Further, except for the low-speed range, "DI RATIO r=100%" holds in the range where the load factor is KL(2) or greater in the map for the warm state, and in the range where the load factor is KL(4) or greater in the map for the cold state. This means that fuel injection is carried out using only in-cylinder injector 110 in the range where the engine speed is at a predetermined high level, and that fuel injection is often carried out using only in-cylinder injector 110 in the range where the engine load is at a predetermined high level. However, in the low-speed and high-load range, mixing of an air-fuel mixture formed by the fuel injected from in-cylinder injector 110 is poor, and such inhomogeneous air-fuel mixture within the combustion chamber may lead to unstable combustion. Thus, the fuel injection ratio of in-cylinder injector 110 is increased as the engine speed increases where such a problem is unlikely to occur, whereas the fuel injection ratio of in-cylinder injector 110 is decreased as the engine load increases where such a problem is likely to occur. These changes in the fuel injection ratio of in-cylinder injector 10, or, the DI ratio r, are shown by crisscross arrows in FIGS. 9 and 10. In this manner, variation in output torque of the engine attributable to the unstable combustion can be suppressed. It is noted that these measures are approximately equivalent to the measures to decrease the fuel injection ratio of in-cylinder injector 10 as the state of the engine moves toward the predetermined low speed range, or to increase the fuel injection ratio of in-cylinder injector 110 as the engine state moves toward the predetermined low load range. Further, except for the relevant range (indicated by the crisscross arrows in FIGS. 9 and 10), in the range where fuel injection is carried out using only in-cylinder injector 110 (on the high speed side and on the low load side), a homogeneous air-fuel mixture is readily obtained even when the fuel injection is carried out using only in-cylinder injector 110. In this case, the fuel injected from in-cylinder injector 110 is atomized within the combustion chamber involving latent heat of vaporization (by absorbing heat from the combustion chamber). Accordingly, the temperature of the air-fuel mixture is decreased at the compression side, and thus, the antiknock performance improves. Further, with the temperature of the combustion chamber decreased, intake efficiency improves, leading to high power output.

In engine 10 explained in conjunction with FIGS. 7–10, homogeneous combustion is achieved by setting the fuel injection timing of in-cylinder injector 110 in the intake stroke, while stratified charge combustion is realized by setting it in the compression stroke. That is, when the fuel injection timing of in-cylinder injector 110 is set in the compression stroke, a rich air-fuel mixture can be located locally around the spark plug, so that a lean air-fuel mixture in the combustion chamber as a whole is ignited to realize the stratified charge combustion. Even if the fuel injection timing of in-cylinder injector 110 is set in the intake stroke, stratified charge combustion can be realized if it is possible to provide a rich air-fuel mixture locally around the spark plug.

As used herein, the stratified charge combustion includes both the stratified charge combustion and semi-stratified charge combustion. In the semi-stratified charge combustion, intake manifold injector 120 injects fuel in the intake stroke to generate a lean and homogeneous air-fuel mixture in the whole combustion chamber, and then in-cylinder injector 110 injects fuel in the compression stroke to generate a rich air-fuel mixture around the spark plug, so as to improve the combustion state. Such semi-stratified charge combustion is preferable in the catalyst warm-up operation for the following reasons. In the catalyst warm-up operation, it is necessary to considerably retard the ignition timing and maintain a favorable combustion state (idling state) so as to cause a high-temperature combustion gas to reach the catalyst. Further, a certain quantity of fuel needs to be supplied. If the stratified charge combustion is employed to satisfy these requirements, the quantity of the fuel will be insufficient. If the homogeneous combustion is employed, the retarded amount for the purpose of maintaining favorable combustion is small compared to the case of stratified charge combustion. For these reasons, the above-described semi-stratified charge combustion is preferably employed in the catalyst warm-up operation, although either of stratified charge combustion and semi-stratified charge combustion may be employed.

Further, in the engine explained in conjunction with FIGS. 7–10, the fuel injection timing of in-cylinder injector 110 is set in the intake stroke in a basic range corresponding to the almost entire range (here, the basic range refers to the range other than the range where semi-stratified charge combustion is carried out with fuel injection from intake manifold injector 120 in the intake stroke and fuel injection from in-cylinder injector 110 in the compression stroke, which is carried out only in the catalyst warm-up state). The fuel injection timing of in-cylinder injector 110, however, may be set temporarily in the compression stroke for the purpose of stabilizing combustion, for the following reasons.

When the fuel injection timing of in-cylinder injector 110 is set in the compression stroke, the air-fuel mixture is cooled by the injected fuel while the temperature in the cylinder is relatively high. This improves the cooling effect and, hence, the antiknock performance. Further, when the fuel injection timing of in-cylinder injector 110 is set in the compression stroke, the time from the fuel injection to the ignition is short, which ensures strong penetration of the injected fuel, so that the combustion rate increases. The improvement in antiknock performance and the increase in combustion rate can prevent variation in combustion, and thus, combustion stability is improved.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A control apparatus for an internal combustion engine having a first fuel injection mechanism injecting fuel into a cylinder and a second fuel injection mechanism injecting the fuel into an intake manifold, comprising:

a controller controlling said first and second fuel injection mechanisms to bear shares, respectively, of injecting the fuel at a ratio calculated as based on a condition required for said internal combustion engine; and a detector detecting a temperature of said internal combustion engine, wherein said controller uses said ratio and said temperature to calculate a fuel variation value for said internal combustion engine in a cold state and applies calculated said fuel variation value to control said first and second fuel injection mechanisms to vary a fuel injection quantity.

2. The control apparatus for an internal combustion engine according to claim 1, wherein said first fuel injection mechanism is an in-cylinder injector and said second fuel injection mechanism is an intake manifold injector.

3. A control apparatus for an internal combustion engine having a first fuel injection mechanism injecting fuel into a cylinder and a second fuel injection mechanism injecting the fuel into an intake manifold, comprising:

a controller controlling said first and second fuel injection mechanisms to bear shares, respectively, of injecting the fuel at a ratio calculated as based on a condition required for said internal combustion engine;

a detector detecting a temperature of said internal combustion engine; and a calculator calculating a reference injection quantity injected from said first and second fuel injection mechanisms, wherein said controller uses said ratio and said temperature to calculate a fuel variation value for said internal combustion engine in a cold state and applies calculated said fuel variation value and said reference injection quantity to control said first and second fuel injection mechanisms to vary a fuel injection quantity.

4. A control apparatus for an internal combustion engine having a first fuel injection mechanism injecting fuel into a cylinder and a second fuel injection mechanism injecting the fuel into an intake manifold, comprising:

a controller controlling said first and second fuel injection mechanisms to bear shares, respectively, of injecting the fuel at a ratio calculated as based on a condition required for said internal combustion engine; and a detector detecting a temperature of said internal combustion engine, wherein said controller uses said ratio and said temperature to calculate a fuel increase value for said internal combustion engine in a cold state and applies calculated said fuel increase value to control said first and second fuel injection mechanisms to vary a fuel injection quantity.

5. The control apparatus for an internal combustion engine according to claim 4, wherein said controller calculates said fuel increase value to be decreased when said first fuel injection mechanism is increased in said ratio.

6. The control apparatus for an internal combustion engine according to claim 4, wherein said controller calculates said fuel increase value to be increased when said second fuel injection mechanism is increased in said ratio.

7. The control apparatus for an internal combustion engine according to claim 4, wherein said controller calculates said fuel increase value to be decreased when said temperature is increased.

8. The control apparatus for an internal combustion engine according to claim 4, wherein said controller calculates said fuel increase value to be increased when said temperature is decreased.

9. A control apparatus for an internal combustion engine having a first fuel injection mechanism injecting fuel into a cylinder and a second fuel injection mechanism injecting the fuel into an intake manifold, comprising:

a controller controlling said first and second fuel injection mechanisms to bear shares, respectively, of injecting the fuel at a ratio calculated as based on a condition required for said internal combustion engine;

a detector detecting a temperature of said internal combustion engine; and a calculator calculating a reference injection quantity injected from said first and second fuel injection mechanisms, wherein said controller uses said ratio and said temperature to calculate a fuel increase value for said internal combustion engine in a cold state and applies calculated said fuel increase value and said reference injection quantity to control said first and second fuel injection mechanisms to vary a fuel injection quantity.

10. A control apparatus for an internal combustion engine having first fuel injection means for injecting fuel into a cylinder and second fuel injection means for injecting the fuel into an intake manifold, comprising:

controlling means for controlling said first and second fuel injection means to bear shares, respectively, of injecting the fuel at a ratio calculated as based on a condition required for said internal combustion engine; and detecting means for detecting a temperature of said internal combustion engine, wherein said controlling means includes means for using said ratio and said temperature to calculate a fuel variation value for said internal combustion engine in a cold state and applying calculated said fuel variation value to control said first and second fuel injection means to vary a fuel injection quantity.

11. The control apparatus for an internal combustion engine according to claim 10, wherein said first fuel injection means is an in-cylinder injector and said second fuel injection means is an intake manifold injector.

12. A control apparatus for an internal combustion engine having first fuel injection means for injecting fuel into a cylinder and second fuel injection means for injecting the fuel into an intake manifold, comprising:

controlling means for controlling said first and second fuel injection means to bear shares, respectively, of injecting the fuel at a ratio calculated as based on a condition required for said internal combustion engine;

detecting means for detecting a temperature of said internal combustion engine; and calculating means for calculating a reference injection quantity injected from said first and second fuel injection means, wherein said controlling means includes means for using said ratio and said temperature to calculate a fuel variation value for said internal combustion engine in a cold state and applying calculated said fuel variation value and said reference injection quantity to control said first and second fuel injection means to vary a fuel injection quantity.

13. A control apparatus for an internal combustion engine having first fuel injection means for injecting fuel into a cylinder and second fuel injection means for injecting the fuel into an intake manifold, comprising:

controlling means for controlling said first and second fuel injection means to bear shares, respectively, of injecting the fuel at a ratio calculated as based on a condition required for said internal combustion engine; and detecting means for detecting a temperature of said internal combustion engine, wherein said controlling means includes means for using said ratio and said temperature to calculate a fuel increase value for said internal combustion engine in a cold state and applying calculated said fuel increase value to control said first and second fuel injection means to vary a fuel injection quantity.

14. The control apparatus for an internal combustion engine according to claim 13, wherein said controlling means calculates said fuel increase value to be decreased when said first fuel injection means is increased in said ratio.

15. The control apparatus for an internal combustion engine according to claim 13, wherein said controlling means includes means for calculating said fuel increase value to be increased when said second fuel injection means is increased in said ratio.

16. The control apparatus for an internal combustion engine according to claim 13, wherein said controlling means includes means for calculating said fuel increase value to be decreased when said temperature is increased.

17. The control apparatus for an internal combustion engine according to claim 13, wherein said controlling means includes means for calculating said fuel increase value to be increased when said temperature is decreased.

18. A control apparatus for an internal combustion engine having first fuel injection means for injecting fuel into a cylinder and second fuel injection means for injecting the fuel into an intake manifold, comprising:

controlling means for controlling said first and second fuel injection means to bear shares, respectively, of injecting the fuel at a ratio calculated as based on a condition required for said internal combustion engine;

detecting means for detecting a temperature of said internal combustion engine; and calculating means for calculating a reference injection quantity injected from said first and second fuel injection means, wherein said controlling means includes means for using said ratio and said temperature to calculate a fuel increase value for said internal combustion engine in a cold state and applying calculated said fuel increase value and said reference injection quantity to control said first and second fuel injection means to vary a fuel injection quantity.

* * * * *